US009416931B1

(12) United States Patent
Ross et al.

(10) Patent No.: US 9,416,931 B1
(45) Date of Patent: Aug. 16, 2016

(54) METHOD OF MAKING A BAMBOO LAMP OR OTHER ITEM

(71) Applicants: Larry D. Ross, Rome, GA (US); Larry E. Ross, Rome, GA (US)

(72) Inventors: Larry D. Ross, Rome, GA (US); Larry E. Ross, Rome, GA (US)

( * ) Notice: Subject to any disclaimer, the term of this patent is extended or adjusted under 35 U.S.C. 154(b) by 0 days.

(21) Appl. No.: 14/805,183

(22) Filed: Jul. 21, 2015

(51) Int. Cl.

| | |
|---|---|
| ***F21S 6/00*** | (2006.01) |
| ***B27J 1/00*** | (2006.01) |
| ***F21V 23/00*** | (2015.01) |
| ***B27K 9/00*** | (2006.01) |

(52) U.S. Cl.
CPC .. *F21S 6/002* (2013.01); *B27J 1/00* (2013.01); *B27K 9/002* (2013.01); *F21V 23/001* (2013.01)

(58) Field of Classification Search
CPC ..... B27J 1/00; B27K 9/002; F21S 6/002; F21V 23/001
See application file for complete search history.

(56) References Cited

U.S. PATENT DOCUMENTS

| | | | | |
|---|---|---|---|---|
| 5,406,466 | A | 4/1995 | Stokes | |
| 6,823,908 | B2 | 11/2004 | Hsu | |
| 8,354,161 | B2 | 1/2013 | Lin et al. | |
| 2005/0121881 | A1 * | 6/2005 | Ambuske | A63C 5/126 280/610 |
| 2006/0205525 | A1 * | 9/2006 | Owen | A63D 15/08 473/44 |

* cited by examiner

*Primary Examiner* — Stephen F Husar
(74) *Attorney, Agent, or Firm* — Crossley and Stevenson Intellectual Property Law

(57) ABSTRACT

A method of making a bamboo lamp or other item from bamboo including the drilling of a center portion of each of a bamboo section and injecting the center portion of at least a portion of the bamboo sections with an injectable spray foam. To make a bamboo lamp, the bamboo sections are dried and divided into base sections filled with foam and the single unfilled shaft section attached together to form a lamp shaft. The right and left ends of each foam-filled base sections are removed and the outer ends remaining are cut at a 30-degree angle, attached to external edges of a lower base, and glued together. An upper base can be attached to the lower base. Each base is drilled to accommodate the necessary light fixture parts for the lamp.

16 Claims, 4 Drawing Sheets

METHOD OF MAKING A BAMBOO LAMP OR OTHER ITEM

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various methods for making items using bamboo are known in the prior art. However, what is needed is a method of making a bamboo lamp or other item including the drilling of an entire longitudinal center portion of each of a bamboo section and injecting the center portion of at least a portion of the bamboo sections with an injectable spray foam. To make a bamboo lamp, the bamboo sections are dried and divided into base sections filled with foam and a single unfilled shaft section for forming a lamp shaft. The right and left ends of each foam-filled base sections are removed and the outer ends remaining are cut at a 30-degree angle, attached to external edges of a lower base, and glued together. An upper base can be attached to the lower base. Each base is drilled to accommodate the necessary light fixture parts for the lamp.

FIELD OF THE INVENTION

The present invention relates to methods for making bamboo items, and more particularly, to a method of making a bamboo lamp or other item including the drilling of a center portion of each of a bamboo section and injecting the center portion of at least a portion of the bamboo sections with an injectable spray foam which provides a bonding surface.

SUMMARY OF THE INVENTION

The general purpose of the present method of making a bamboo lamp or other item, described subsequently in greater detail, is to provide a method of making a bamboo lamp or other item which has many novel features that result in a method of making a bamboo lamp or other item which is not anticipated, rendered obvious, suggested, or even implied by prior art, either alone or in combination thereof.

To accomplish this, the present method of making a bamboo lamp or other item includes the drilling of a center portion of each of a bamboo section and injecting the center portion of at least a portion of the bamboo sections with an injectable spray foam. To make a bamboo lamp, the bamboo sections are dried and divided into base sections filled with foam and a single unfilled shaft section for forming a lamp shaft. The right and left ends of each foam-filled base sections are removed and the outer ends remaining are cut at a 30-degree angle, attached to external edges of a lower base, and glued together. An upper base can be attached to the lower base. Each base is drilled to accommodate the necessary light fixture parts for the lamp.

Thus has been broadly outlined the more important features of the present method of making a bamboo lamp or other item so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
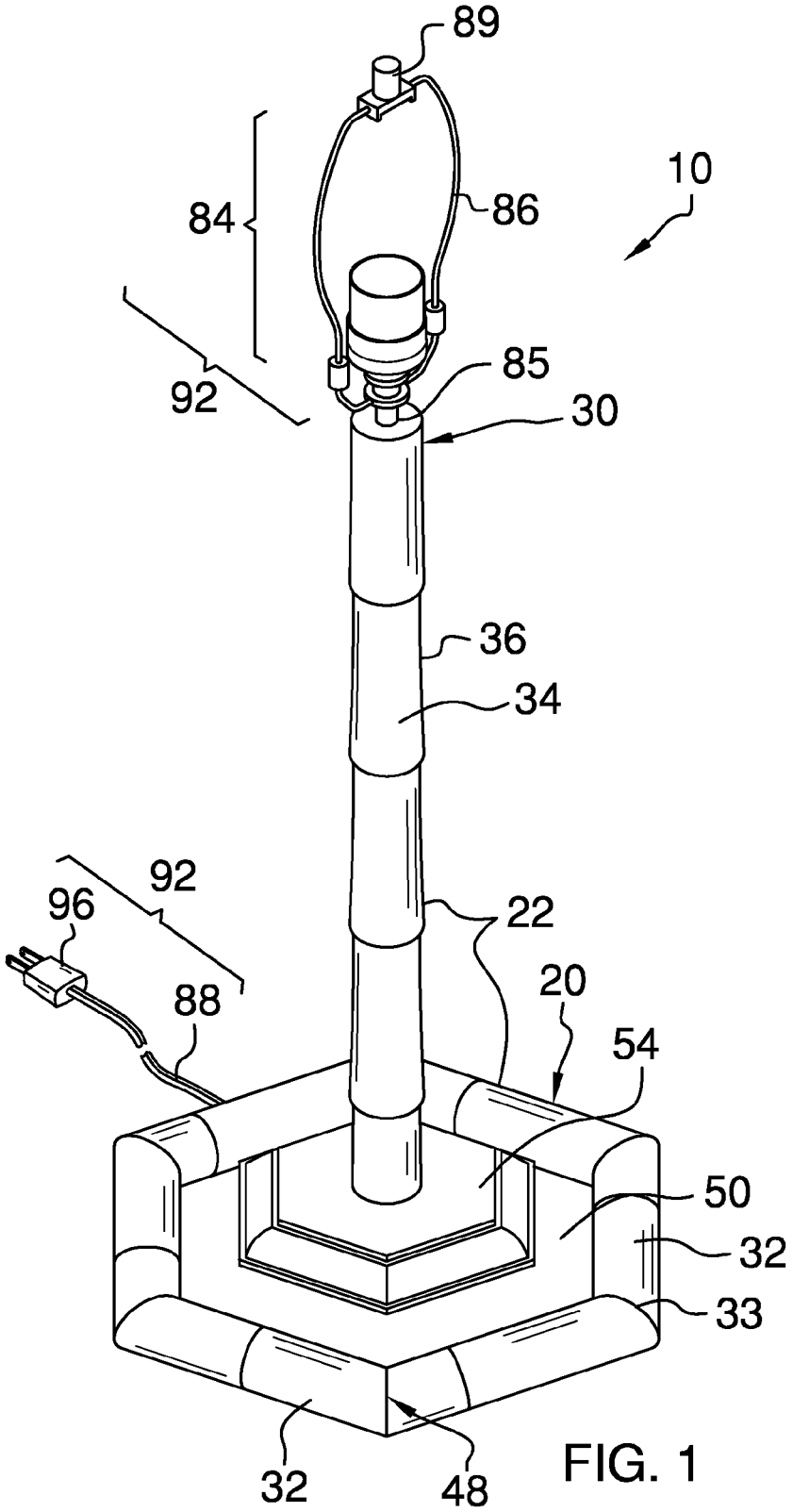
FIG. 1 is an isometric view of a bamboo lamp constructed according to the present method.
Figure 2:
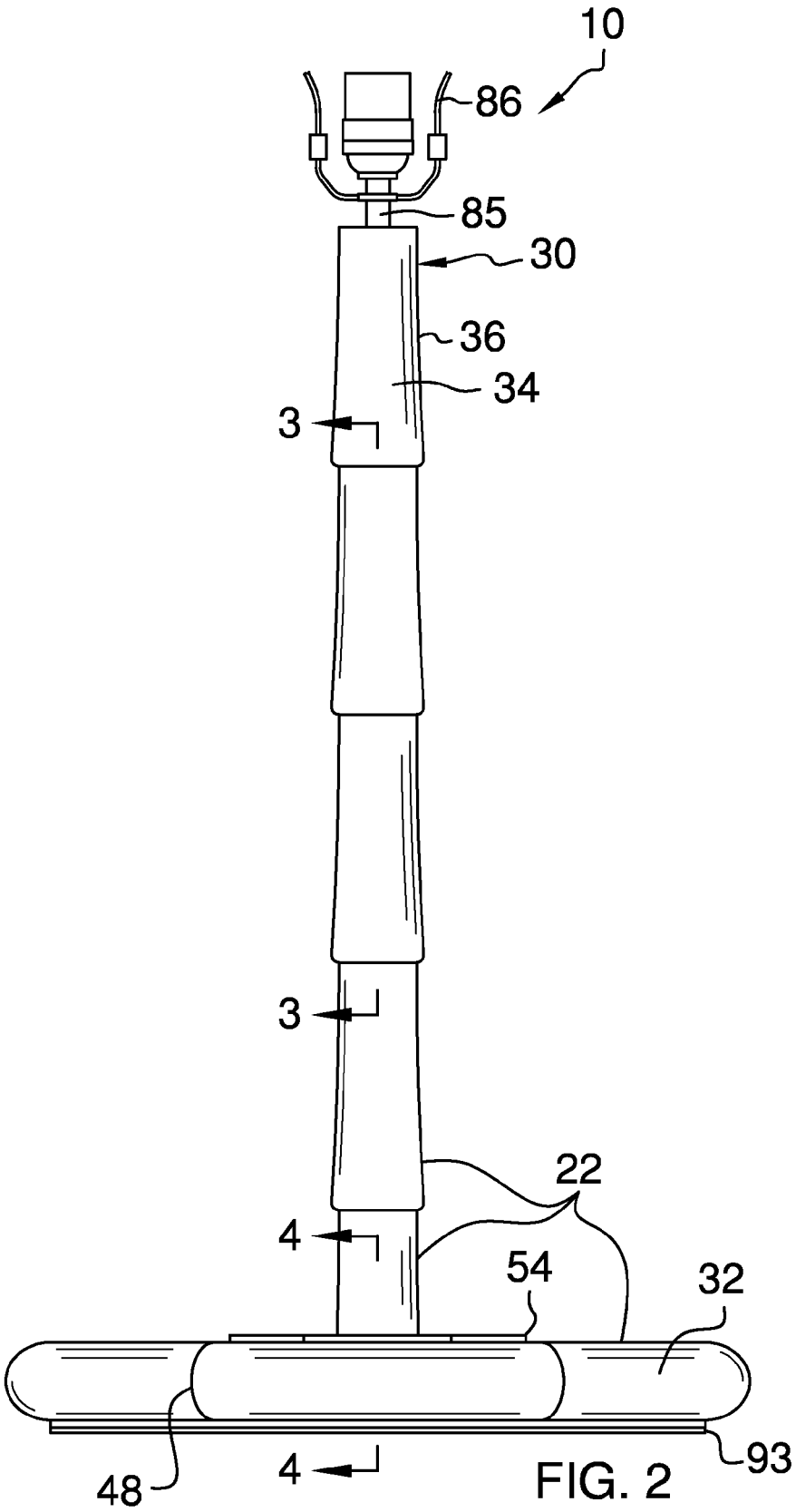
FIG. 2 is a rear elevation view.
Figure 3:
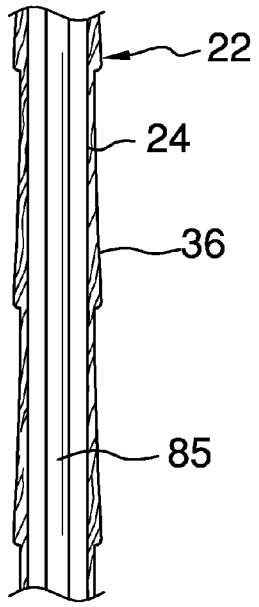
FIG. 3 is a cross-sectional view taken along line 3-3 of FIG. 2.
Figure 4:
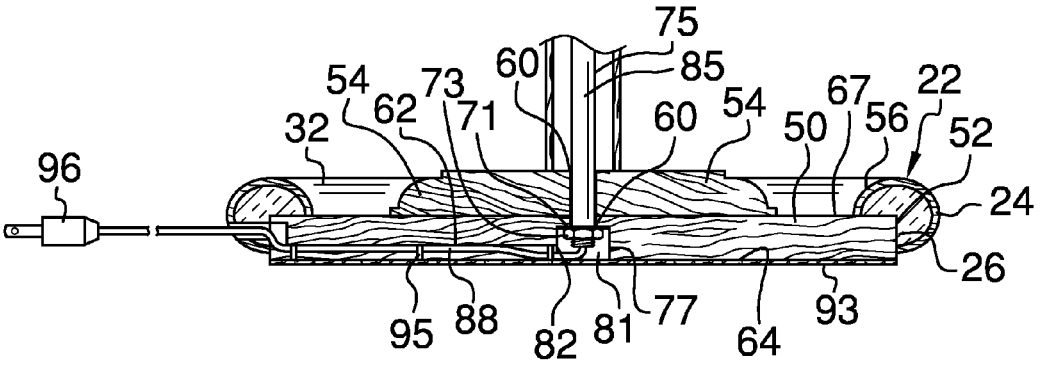
FIG. 4 is a cross-sectional view taken along line 4-4 of FIG. 2.
Figure 5:
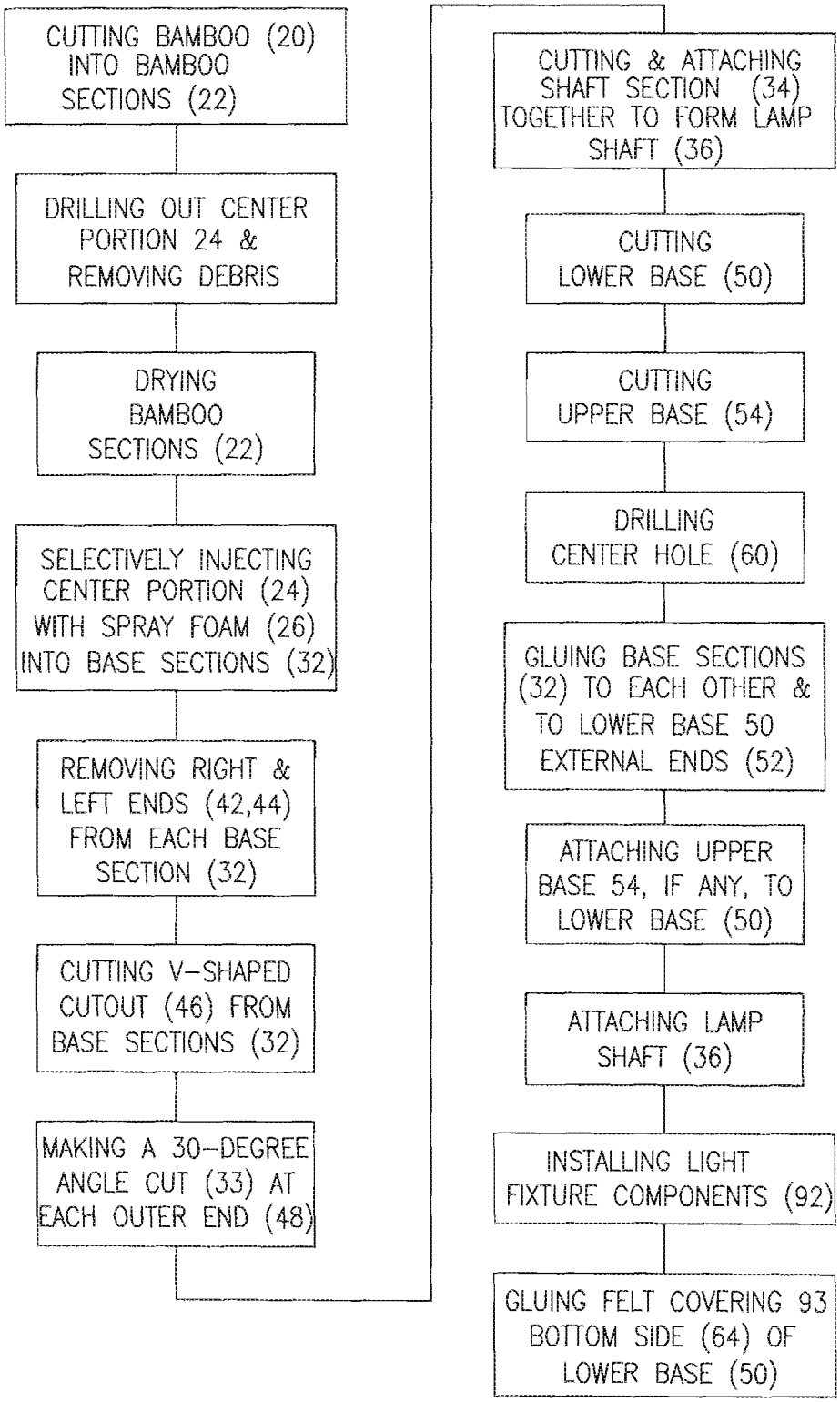
FIG. 5 is a block diagram of the present method of making a bamboo lamp or other item.

With reference now to the drawings, and in particular FIGS. 1 through 5 thereof, an example of the instant method of making a bamboo lamp or other item employing the principles and concepts of the present method of making a bamboo lamp or other item and generally designated by the reference number 10 will be described.

Referring to FIGS. 1 through 5 the present method of making a bamboo lamp or other item 10 is illustrated. The method of making a bamboo lamp or other item 10 generally includes cutting an amount of bamboo 20 into a plurality of bamboo sections 22. Each bamboo section 22 has a center portion 24 therein directly adjacent the midline longitudinal axis thereof. The method continues with drilling out the entire center portion 24 of each bamboo section 22. Any debris formed within the center portion 24 by the drilling of the center portion 24 should be removed, such as by blowing the debris out of the center portion 24. The center portion 24 of each bamboo section 22 is drilled out to have a ⅜ inch diameter. After the center portion 24 is drilled out, the each bamboo section 22 is dried as discussed hereinbelow. After each bamboo section 22 is dried, the entire center portion 24 of at least a portion of the bamboo sections 22 is then filled with an injectable spray foam 26, which is allowed to dry. Once the center portion 24 of each bamboo section 22 is completely dry, the bamboo sections 22 are secured together to form an item. One such item that can be formed is a bamboo lamp 30, although the method can also be used to form other items such as a jewelry box or a picture frame.

In order to make a bamboo lamp 30, the method begins with the selection of an amount of bamboo 20 having a straight longitudinal midline axis and then cutting the amount of bamboo 20 into a plurality of bamboo sections 22, wherein each bamboo section 22 has a center portion 24 directly adjacent the midline axis such that each bamboo section 22 has a length in a range of 4 inches to 48 inches. To make the bamboo lamp 30, just as with other items that can be formed from bamboo according to the present method, the entire center portion 24 of each bamboo section 24 is drilled out. Any debris in the center portion 24 must be removed from the center portion 24, preferably by blowing the debris out of the center portion 24. Once the debris is removed, each bamboo section 22 is dried with an open flame while turning the respective bamboo section 22 until the bamboo section 22 achieves a desired burnished color. Oil and dirt from the respective bamboo section 22 is wiped off while being dried.

A torch is recommended as the source of the open flame when drying each bamboo section 22. Once the bamboo sections 22 have achieved the desired burnished color, the bamboo sections 22 are divided into a plurality of base sections 32 and a single shaft section 34. The base sections 32 are selected for forming a continuous edging on a lower base 50 of the bamboo lamp 30. The shaft section 34 is selected for forming a lamp shaft 36 of the bamboo lamp 30. Next, the entire center portion 24 of only the base sections 32 is completely filled with the injectable spray foam 26 and the injectable spray foam 26 is allowed to dry inside the center portion 24 of each base section 32. The center portion 24 of the shaft section 34 is maintained in an empty condition.

After the injectable spray foam 26 is dry, each of a right end 42 and a left end 44 having the injectable spray foam 26 of each base section 32 is removed The right and left ends 42, 44 can be removed by snapping them off. A continuous "V"-shaped longitudinal cutout 46 is then cut from each base section 32. The cutout 46 is one-quarter of the diameter of the base section 32. The cutout 46 from each base section 32 must be removed.

After the cutout 46 is removed from each base section 32, each of an outer end 48 remaining on each base section 32 is cut at a 30-degree angle cut 33 from midline longitudinal axis. Taping the outer ends 48 prior to cutting them is recommended to prevent splintering. In addition, the location of the cut 33 at each of the outer ends 48 should not be in a knot in order to form smoother cuts and to facilitate attachment of each outer end 48 to an adjacent outer end 48 during final assembly of the bamboo lamp 30. In addition, while cutting each of the outer ends 48, placement of the cutout 46 directly abutting an upper external 90° edge of a jig block is recommended to stabilize the base section 32 during the cutting process. The shaft section 34 must also be cut into a desired length.

During the process of making the bamboo lamp 30, the lower base 50 is cut from a piece of wood having a depth, which is preferably ¾ inches. The cutting of the lower base 50 forms external edges 52 thereof. The lower base 50 can be cut to a variety of shapes, such as hexagonal or parallelepiped.

An upper base 54 having a shorter maximum length and a shorter maximum width than a maximum length and a maximum width of the lower base 50 is also cut from a piece of wood having a same depth as the wood from which the lower base 50 is cut. In addition, the upper base 54 preferably has the same shape as the lower base 50. The bamboo lamp 30 can, however, be formed with or without the upper base 54. The cutting of the upper base 54 forms outer edges 56 thereof. Each of the lower base 50 external edges 52 and the upper base 54 outer edges 56 is preferably sanded to achieve smoothness.

A center hole 60 is drilled in each of the upper base 54 and the lower base 50. The center hole 60 has a diameter in a range of ¼ inch to ⅜ inch. Once the center hole 60 is drilled, a ¼-inch deep wiring slot 62 is cut into a bottom side 64 of the lower base 50 from the center hole 60 to the external edge 52.

When attaching the lower base 50 and the upper base 54 to each other, the use of a top jig, which can have a same shaped top side as the lower base 50, is recommended. When the top jig is employed to assemble the lower and upper bases 50, 54, the lower base 50 is placed atop the top jig, which has been previously attached to a bottom jig having a central aperture having a diameter equal to a diameter of the center hole 60 of each of the upper and lower base 50, a shaft centrally disposed therein, a maximum width in a range of ¼ inch to 2 inches wider than a width of the lower base 50, and at least a pair of, but not more than 3 of, spaced apart fasteners, which are preferably screws, disposed on each of an outer side of the jig. Each fastener has a head portion and a shaft portion. The lower base 50 is placed atop the top jig with the shaft through the lower base 50 center hole 60. While allowing the glue to dry when securing the external edges 52 and the base sections 32 together, a bungee strap can be attached from the head of each fastener across the respective base section 32 and the base to the head of the fastener positioned diametrically opposite therefrom to hold each base section 32 to the respective external edge 52 of the lower base 50 and maintaining the bungee straps in place.

When preparing to attach the upper base 54 to the lower base 50, the grain and the corners of each of the lower and upper base 50, 54 must be aligned. The upper base 54 is attached to the lower base 50 by gluing the upper base 54 to a center of an upper side 67 of the lower base 50 with the center hole 60 of each of the lower and upper bases 50, 54 vertically aligned. After the lower and upper bases 50, 54 are glued together, a washer 71 and a nut 73 are added onto the shaft 75 placed through the center holes 60 of the lower and upper bases 50, 54 prior to gluing them together. This shaft 75 can be the shaft disposed in the bottom jig. The glue must be allowed to dry for a secure attachment of the upper base 54 to the lower base 50.

Regardless of whether an upper base 54 is attached to the lower base 50, the base sections 32 must be secured to the external edges 52 of the lower base 50. The filling of the base sections 32 with the injectable spray foam 26 along with the 30-degree angle cut 33 permits the base sections 32 to be better bonded than bonding with an unfilled center portion 24 and at a right angle cut by providing a larger bonding surface. If a top jig is employed to assist in the assembly of the bamboo lamp 30, the base sections 32 are aligned with the lower base 50 external edges 52 while placing the base sections 32 atop the top jig. The base sections 32 are secured to the external edges 52 by gluing the base sections 32 to the external edges 52 and then wiping off any excess glue and allowing the glue to completely dry. Once the base sections 32 are secured to the external edges 52 of the lower base 50 and the glue is completely dry, the lower and upper bases 50, 54 are removed from the top and bottom jigs, if used, and assembly proceeds with the drilling of an opening 77, having a diameter of ¼ inch, in one of the base sections 32 on a predetermined back side 79 of the lower base 50 at a position ¼ inch away from the wiring slot 62 in the lower base 50. Next, a washer slot 81 with a depth of ⅜ inches is drilled in the bottom side 64 of the lower base 50 in alignment with the center hole 60 and a ½ inch second hole 82 is drilled through the lower and upper bases 50, 54 in alignment with the washer slot 81. This drilling is followed by attaching a threaded rod assembly 84 having a rod 85 and a harp bracket 86 to the lamp shaft 36, the upper base 54, and the lower base 50 by inserting the rod 85 through the entire lamp shaft 36, the upper base 54, and the lower base 50 and attaching and tightening the washer 71 and the nut 73 onto the rod 85 at the bottom side 64 of the lower base 50.

All of an exposed portion of the lower and upper bases 50, 54 and the lamp shaft 36 is selectively stained and varnished. The application of a pre-stain conditioner to each base section 32 prior to staining each base section 32 is recommended.

Once the upper and lower bases 50 are secured together with the base sections 32 secured to the external edges 52 of the lower base 50 and all drilling has been completed, the shaft 75 is removed and an amount of electrical wiring 88 which, along with the electrical plug 96 and the threaded rod assembly 84, are the light fixture components 92, is inserted through the second hole 82 and the wiring slot 62 and then through the lower and upper bases 50, 54 and the lamp shaft 36 while leaving a portion of the electrical wiring 88 protruding proximal the bottom side 64 of the lower base 50. Next, a top cap 89 is secured to the harp bracket 86. Any of the electrical wiring 88 that is excess is then pulled out of the center hole 60 on the bottom side 64 of the lower base 50 and the electrical wiring 88 is secured within the wiring slot 62 with staples 95. A felt covering 93 having the substantially the same dimensions as the bottom side 64 of the lower base 50 is glued to the bottom side 64 of the lower base 50.

In addition to the foregoing, the upper base 54 outer edges 56 are selectively routed and sanded prior to the attachment of the upper base 54 to the lower base 50 to provide an additional structural enhancement to the bamboo lamp 30.

What is claimed is:

1. A method of making an item from bamboo comprising:

cutting an amount of bamboo into a plurality of bamboo sections, wherein each bamboo section has a center portion therein directly adjacent the midline longitudinal axis thereof;

drilling out the entire center portion of each bamboo section;

filling the entire center portion of at least a portion of the bamboo sections with an injectable spray foam;

allowing the injectable spray foam to dry inside the center portion; and securing the bamboo sections together to form an item.

2. A method of making a bamboo lamp comprising:

cutting a lower base for a bamboo lamp from a piece of wood, wherein the cutting of the lower base forms external edges of the lower base;

selecting an amount of bamboo having a straight longitudinal midline axis;

cutting the amount of bamboo into a plurality of bamboo sections, wherein each bamboo section has a center portion therein directly adjacent the midline longitudinal axis, further wherein each bamboo section has a length in a range of 4 inches to 48 inches;

dividing the bamboo sections into a plurality of base sections and a single shaft section, the base sections being selected for forming a continuous edging along the external edges of the lower base, the shaft section being selected for forming a lamp shaft of the bamboo lamp, wherein each base section has a right end and a left end, wherein each base section has a length substantially a same length as each of the other base sections;

drilling out the entire center portion of each bamboo section;

drying each bamboo section with an open flame while turning the respective section until the section achieves a desired burnished color;

wiping off oils and dirt from the respective bamboo section during the drying of the respective section;

filling the entire center portion of only the base sections with an injectable spray foam;

allowing the injectable spray foam to dry inside the center portion of each base section;

cutting off each of a right end and a left end of each base section having injectable spray foam protruding therefrom;

maintaining the center portion of the shaft section in an open condition;

cutting a continuous "V"-shaped longitudinal cutout from each base section, wherein the cutout is ¼ of the diameter of the base section, and removing the cutout from the base section;

cutting each of an outer end remaining on each base section after the right and left ends have been separated from the base section at a 30-degree angle from midline longitudinal axis upon removal of the cutout from the base section;

cutting the shaft section into a desired length;

drilling a center hole in each of the lower base, the center hole having a diameter in a range of ¼ inch to ⅜ inch;

cutting a wiring slot having a depth of ¼ inch into a bottom side of the lower base from the center hole to the external edge;

aligning each of the base sections with one of the lower base external edges and gluing the base sections securely to the external edges;

wiping off any excess glue and allowing the glue to completely dry;

drilling an opening having a diameter of ¼ inch in one of the base sections on a predetermined back side of the lower base at a position ¼ inch away from the wiring slot in the lower base;

drilling a washer slot with a depth of ⅜ inches in the bottom side of the lower base in alignment with the center hole;

drilling a ½ inch second hole through the lower base in alignment with the washer slot;

attaching a threaded rod assembly having a rod and a harp bracket to the lamp shaft and the lower base by inserting the rod through the entire lamp shaft and the lower base and attaching and tightening a washer and a nut onto the rod at the bottom side of the lower base;

inserting an amount of electrical wiring through the through the second hole and the slot and then through the lower base and the lamp shaft and leaving a lower portion of the electrical wiring protruding proximal the bottom side of the lower base; and pulling any of the electrical wiring that is excess out of the center hole on the bottom side of the base and securing the electrical wiring within the slot.

3. The method of making a bamboo lamp of claim 2 further comprising:

cutting an upper base having a shorter maximum length and a shorter maximum width than a maximum length and a maximum width of the lower base from a piece of wood, wherein the cutting of the upper base forms outer edges of the upper base;

drilling a center hole in the lower base, the center hole having a diameter in a range of ¼ inch to ⅜ inch;

aligning a grain and each of a corner of each of the upper and lower bases;

attaching the upper base to the lower base, with the grain and the corners of the lower and upper bases in alignment, by gluing the upper base to a center of an upper side of the lower base with the center hole of each of the upper and lower bases in vertical alignment;

allowing the glue to dry for a secure attachment of the upper base to the lower base;

further drilling the ½ inch second hole through the upper base in alignment with the washer slot;

further attaching the threaded rod assembly to the upper base by further inserting the rod through the upper base and attaching and tightening a washer and a nut onto the rod at the bottom side of the lower base; and further inserting the amount of electrical wiring through the upper base.

4. The method of making a bamboo lamp of claim 2 further comprising:

using a torch as a source of the open flame when drying each bamboo section.

5. The method of making a bamboo lamp of claim 2 further comprising:

taping each outer end of each base section immediately prior to cutting each outer end at the 30-degree angle from midline longitudinal axis.

6. The method of making a bamboo lamp of claim 2 further comprising:

selectively staining and varnishing the lower base and the lamp shaft.

7. The method of making a bamboo lamp of claim 2 further comprising adding and securing a top cap to the harp bracket.

8. The method of making a bamboo lamp of claim 3 further comprising:

using a torch as the source of the open flame when drying each bamboo section.

9. The method of making a bamboo lamp of claim 3 further comprising:

taping each outer end of each base section immediately prior to cutting each outer end at the 30-degree angle from midline longitudinal axis.

10. The method of making a bamboo lamp of claim 3 further comprising:

selectively staining and varnishing the upper base.

11. The method of making a bamboo lamp of claim 3 further comprising:

selectively staining and varnishing the lower base and the lamp shaft.

12. The method of making a bamboo lamp of claim 3 further comprising adding and securing a top cap to the harp bracket.

13. A method of making a bamboo lamp comprising:

selecting an amount of bamboo having a straight longitudinal midline axis;

cutting the amount of bamboo into a plurality of bamboo sections, wherein each bamboo section has a center portion directly adjacent the midline axis, further wherein each bamboo section has a length in a range of 4 inches to 48 inches;

drilling out the entire center portion of each bamboo section;

drying each bamboo section with an open flame while turning the respective section until the bamboo section achieves a desired burnished color;

wiping off oils and dirt from the respective section during the drying of the respective bamboo section;

dividing the bamboo sections into a plurality of base sections and a single shaft section, the base sections being selected for forming a base of the bamboo lamp, the shaft section being selected for forming a lamp shaft of the bamboo lamp;

filling the entire center portion of only each of the base sections with an injectable spray foam;

allowing the injectable spray foam to dry inside the center portion of each base section;

cutting off each of a right end and a left end of each base section having injectable spray foam protruding therefrom;

maintaining the center portion of the shaft section in an empty condition;

cutting a continuous "V"-shaped longitudinal cutout from each base section, wherein the cutout is ¼ of the diameter of the base section, and removing the cutout from the base section;

taping each of an outer end of each base section remaining on each base section after the right and left ends have been separated from the base section upon removal of the cutout from the base section;

cutting each outer end of each base section at a 30-degree angle from midline longitudinal axis;

cutting the shaft section into a desired length;

cutting a hexagonal lower base from a piece of wood having a depth of ¾ inches, wherein the cutting of the lower base forms external edges of the lower base;

cutting a hexagonal upper base having a shorter maximum length and a shorter maximum width than a maximum length and a maximum width of the lower base from a piece of wood having a depth of ¾ inches, the cutting of the upper base forming outer edges thereof;

sanding each of the lower base external edges and the upper base outer edges to achieve smoothness;

drilling a center hole in each of the upper base and the lower base, the center hole having a diameter in a range of ¼ inch to ⅜ inch;

cutting a ¼ inch deep wiring slot into a bottom side of the lower base from the center hole to the external edge;

placing a shaft through the lower base center hole;

aligning the grain and the corners of each of the upper and lower bases;

attaching the upper base to the lower base by gluing the upper base to a center of an upper side of the lower base with the center hole of each of the upper and lower bases vertically aligned, inserting a washer and a nut onto the shaft;

allowing the glue to dry for a secure attachment of the upper base to the lower base;

aligning each of the base sections with one of the lower base external edges and gluing the base sections securely to the external edges;

wiping off any excess glue and allowing the glue to completely dry;

removing the shaft after the glue completely dries to secure the base sections to the external edges;

drilling an opening having a diameter of ¼ inch in one of the base sections on a predetermined back side of the lower base at a position ¼ inch away from the wiring slot in the lower base;

drilling a washer slot with a depth of ⅜ inches in the bottom side of the lower base in alignment with the center hole;

drilling a ½ inch second hole through the lower and upper bases in alignment with the washer slot;

attaching a threaded rod assembly having a rod and a harp bracket to the lamp shaft, the upper base, and the lower base by inserting a the rod assembly through the entire lamp shaft, the upper base, and the lower base and attaching and tightening a washer and a nut onto the rod at the bottom side of the lower base;

selectively staining and varnishing all of an exposed portion of the lower and upper bases and the lamp shaft;

inserting an amount of electrical wiring through the through the second hole and the slot and then through the lower and upper bases and the lamp shaft and leaving a lower portion of the electrical wiring protruding proximal the bottom side of the lower base;

adding and securing a top cap to the harp bracket;

pulling any of the electrical wiring that is excess out of the center hole on the bottom side of the base and securing the electrical wiring within the slot with staples; and gluing a felt covering having the substantially the same dimensions as the bottom side of the lower base to the bottom side of the lower base.

14. The method of making a bamboo lamp of claim 13 further comprising:

drilling out center portion to a diameter of ⅜ inch.

15. The method of making a bamboo lamp of claim 14 further comprising:

selectively routing and sanding the upper base outer edges.

16. The method of making a bamboo lamp of claim 13 further comprising:

using a torch as the source of the open flame when drying each bamboo section.

* * * * *